United States Patent [19]

Van Esdonk et al.

[11] Patent Number: 4,904,897

[45] Date of Patent: Feb. 27, 1990

[54] OXIDE CATHODE

[75] Inventors: Johannes Van Esdonk; Jan Hasker; Jacobus Stoffels, all of Eindhoven, Netherlands

[73] Assignee: U.S. Philips Corporation, New York, N.Y.

[21] Appl. No.: 677,948

[22] Filed: Dec. 4, 1984

[30] Foreign Application Priority Data

Dec. 22, 1983 [NL] Netherlands ..... 8304401

[51] Int. Cl.[4] ..... H01J 1/14

[52] U.S. Cl. ..... 313/346 R; 313/355

[58] Field of Search ..... 313/355, 346 R, 346 DC

[56] References Cited

U.S. PATENT DOCUMENTS 3,553,521 1/1971 Bakker et al. ..... 313/355

4,371,589 2/1983 Warner et al. ..... 428/548

4,471,260 9/1984 Hasker et al. ..... 313/346 R 4,533,852 8/1985 Frank et al. ..... 313/346 DC

*Primary Examiner*—Robert L. Griffin

*Assistant Examiner*—T. Salindong

*Attorney, Agent, or Firm*—Robert J. Kraus

[57] ABSTRACT

An oxide cathode comprising a base 1 which consists substantially of titanium and a heater element 5 coated with aluminium oxide 6 to heat the base 1, which bears a porous alkaline earth metal oxide emissive layer 4. When the surface of the titanium base 1 which is opposed to the heater element 5 bears a metal layer 7 consisting at least of one of the metals Pt, Mo, Ta and W, a solution is obtained to the problem occurring in titanium cathodes in that titanium in contact with aluminium oxide is not chemically stable. The metal layer preferably consisits of pure tungsten and is formed by chemical vapour desposition (CVD). The metal layer is preferably from 1 to 10 μm thick.

4 Claims, 1 Drawing Sheet

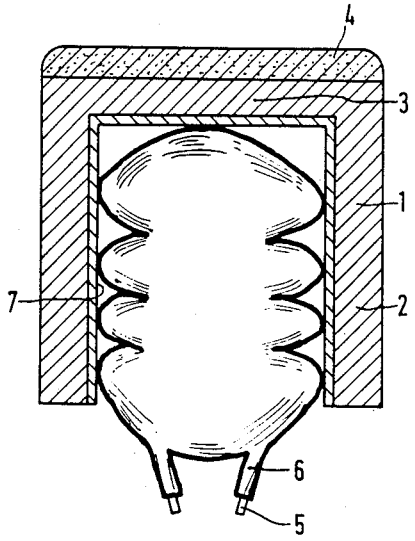
4
3
1
7
2
6
5

OXIDE CATHODE

BACKGROUND OF THE INVENTION

The invention relates to an oxide cathode comprisimg a base which consists at least substantially of titanium and an aluminium oxide-coated heater element to heat the base, an alkaline earth metal oxide-containing porous layer being provided on the base.

Such an oxide cathode is known from the specification of European Patent Application No. 0059491 laid open to public inspection the subject matter of which specification is considered to be incorporarted in the present specification. In the above Application it is remarked that aluminium oxide is used in most cases for the electrical insulation between the heater element and the base, but aluminium oxide, is not chemically stable in contact with titanium, as a result of which insulation problems may start to occur during the life of the cathode. From the point of view of stability and other thermal and electrical properties, berylium oxide is a very suitable insulation material. A disadvantage, however, is that it is very poisonous. Another suitable insulation material is yttrium oxide, but this is much more difficult to provide on a tungsten heater element than aluminium oxide.

SUMMARY OF THE INVENTION

It is therefore an object of the invention to provide an oxide cathode having a base which consists at least substantially of titanium, and an aluminium oxidecoated heater element, in which cathode the aluminium oxide does not react with the titanium.

Netherlands Patent Specification No. 153,018 (corresponding to U.S. Pat. No. 3,553,521) discloses an indirectly heated cathode which comprises an aluminium oxide-coated heater element and a base which consists of molybdenum at least on its side facing the heater element. In order to prevent the molybdenum from diffusing into the aluminium oxide and giving rise to insulation problems, in particular when a potential difference of more than 400 V occurs between the base and the heater element, the base being positive with respect to the heater element, a layer which is at least 3 μm thick of at least one of the metals of the platinum group is provided on the molybdenum of the base. However, not only does this Patent Specification not relate to a titanium base, a solution is also given to quite a different problem, namely diffusion of molybdenum into aluminium oxide.

The present invention provides an oxide cathode comprising a base consisting at least substantially of titanium, an aluminium oxide-coated heater element for heating the base, and a porous alkaline earth metal oxide emissive layer on the base, and wherein a metal layer consisting of at least one of the metals Pt, Mo, Ta and W covers the surface of the base opposed to the heater element.

The present invention provides a solution to the problem which occurs in titanium cathodes in that the titanium in contact with aluminium oxide is not chemically stable. At the comparatively low operating temperature of titanium cathodes, 700° C. instead of 800° C. or higher, molybdenum (which might give rise to insulation problems at higher temperatures, as has appeared from Netherlands Patent Specification No. 153,018) is also suitable to serve as the metal layer between aluminium oxide and titanium. An advantage of using a metal as an intermediate layer between the titanium base and the aluminium oxide is that it can be provided simply, for example, by vapour deposition by sputtering or by electroplating. The above-mentioned metals are stable with respect to aluminium oxide ($A1_2O_3$) and are therefore suitable as a spacer layer between titanium and the filament to prevent reduction of the aluminium oxide filament insulation. Diffusion of the metals into the titanium of the cathode base which usually is sleeve-like might, considering the life, on the one hand lead to a barrier layer which reduces the emission between the titanium and the alkaline earth oxide, and, on the other hand, to the disappearance of the spacer layer between the titanium and the filament insulation. Due to the low rate of diffusion of tungsten into titanium, it is particularly favourable to use tungsten for the metal layer. The metal layer can be provided on the inside of titanium cathode shafts in a simple manner by means of chemical vapour deposition (CVD). Another advantage of the CVD-coating is that up to the comparatively large layer thickness of approximately 10 μm, no detrimental effects are experienced from the difference in expansion upon heating (between titanium and tungsten). The resulting, adherent, more or less porous metal layer is sufficiently flexible to compensate for this difference, so that delamination is prevented. It is to be noted that the advantages of this structure are, of course, not restricted to tungsten.

As already mentioned hereinbefore, it is possible to provide every cathode base with such a metal layer. Another possibility is to manufacture the base from titanium sheet material which is coated with a metal layer of a metal or an alloy of two or more of the metals Pt, Ta, Mo and W. It is possible, for example, to manufacture a cup-shaped base by a deep-drawing process from sheet material. However, it is also possible by means of CVD to coat the inside of a cup-shaped base of titanium, as a result of which the possibility of damage is reduced. Metal layers having thicknesses from 1 to 10 μm have proved to be particularly favourable.

BRIEF DESCRIPTION OF THE DRAWING

Two embodiments of the invention will now be described, by way of example, with reference to two examples and to a drawing, the sole FIGURE of which is a side-sectional view of a cathode according to the invention.

DESCRIPTION OF THE PREFERRED EMBODIMENTS

EXAMPLE 1

This cathode consists of a titanium base 1 which has the form of a cup with a height of 2.2 mm and a diameter of 1.8 mm. The thickness of the wall of this cup is 40 μm and the thickness of the bottom of the cup is 40 μm. On the outside of the bottom 3 of the base 1 a porous emissive layer 4 consisting of barium oxide (Ba0) and strontium oxide (Sr0) and optionally calcium oxide (Ca0) was formed after a coating comprising the corresponding carbonates had been applied to the bottom 3 of the base 1, had been fired and then activated in a vacuum. A tungsten heater wire 5 which was coated with aluminium oxide 6 was provided in the cup-shaped base 1. The inside of the cup-shaped base 1 was coated with a 2 μm thick layer 7 of tungsten by means of CVD, as a result of which the titanium of the base could not reduce the aluminium oxide. The diffusion of the tungsten into the titanium of the base 1 was so small that no barrier layer was formed between the layer 4 and the bottom 3 of the cup-shaped base 1 during the life of the cathode.

EXAMPLE 2

The cup-shaped base 1 of the cathode shown in the Figure was manufactured from titanium sheet material which had been coated with a 5 μm thick layer of platinum, preferably by electroplating. After deepdrawing the cup-shaped base 1 from the coated sheet material, the cathode was obtained by providing the emissive layer 4 and the heater wire 5 coated with aluminium oxide 6. The platinum layer prevented the titanium of the base 1 from reducing the aluminium oxide 6.

What is claimed is:

1. An oxide cathode comprising a base consisting essentially of titanium having one side supporting an alkaline earth metal oxide porous emissive layer and including, adjacent an opposite side of the base, an aluminum oxide coated heater element, characterized in that a metal layer consisting essentially of tungsten is disposed on said opposite side of the base between the heater element and the base.

2. An oxide cathode comprising a base consisting essentially of titanium having one side supporting an alkaline earth metal oxide porous emissive layer and including, adjacent an opposite side of the base, an aluminum oxide coated heater element, characterized in that a metal layer consisting essentially of molybdenum is disposed on said opposite side of the base between the heater element and the base.

3. An oxide cathode as in claim 1 or 2 characterized in that said metal layer comprises a chemical vapor deposition coating.

4. An oxide cathode as in claim 1 or 2 characterized in that said metal layer has a thickness of approximately 1 to 10 microns.

* * * * *